US008746771B1

(12) United States Patent
Farber

(10) Patent No.: US 8,746,771 B1
(45) Date of Patent: Jun. 10, 2014

(54) REMOVABLE LITTER SUPPORT ASSEMBLY

(71) Applicant: Kenneth J. Farber, Granville, OH (US)

(72) Inventor: Kenneth J. Farber, Granville, OH (US)

(73) Assignee: Farber Specialty Vehicles, Inc., Reynoldsburg, OH (US)

( * ) Notice: Subject to any disclaimer, the term of this patent is extended or adjusted under 35 U.S.C. 154(b) by 0 days.

(21) Appl. No.: 13/841,097

(22) Filed: Mar. 15, 2013

(51) Int. Cl.
*A61G 1/06* (2006.01)
*A61G 3/00* (2006.01)

(52) U.S. Cl.
USPC ..... 296/19; 296/24.38; 5/9.1; 5/118; 5/620; 5/625; 5/627

(58) Field of Classification Search
CPC ..... A61G 1/06; A61G 3/00; A61G 3/08; A61G 3/0816; A61G 3/0825; A61G 3/0833; A61G 3/0841; A61G 3/085; A61G 3/0858; A61G 3/0866; A61G 3/0875; A61G 3/0883; A61G 3/0891; B60P 3/39
USPC ..... 296/19, 24.38; 5/8, 9.1, 620, 621, 5/625–627, 118; 108/106; 244/118.6
See application file for complete search history.

(56) References Cited

U.S. PATENT DOCUMENTS 1,292,251 A * 1/1919 Carreira ..... 296/19
1,341,441 A * 5/1920 Sagel ..... 5/194
2,391,051 A * 12/1945 Windsor ..... 5/9.1
2,473,364 A * 6/1949 Dickinson et al. ..... 5/9.1
2,480,322 A * 8/1949 Cozzoli ..... 244/118.6
4,378,128 A * 3/1983 Holling et al. ..... 296/19
4,397,432 A * 8/1983 Resetar ..... 244/118.6
4,425,978 A * 1/1984 Star ..... 180/243
5,383,629 A * 1/1995 Morgan ..... 244/118.6
7,028,351 B1 * 4/2006 Frieder et al. ..... 5/118
7,857,259 B2 * 12/2010 Baatz et al. ..... 244/122 R
7,881,133 B2 * 2/2011 Hwang et al. ..... 365/200
7,931,321 B2 * 4/2011 Kapoor ..... 296/19
8,104,814 B2 * 1/2012 Sartin et al. ..... 296/24.38
8,146,975 B2 * 4/2012 Kapoor ..... 296/19
8,276,962 B2 * 10/2012 Chinn ..... 296/19
8,328,260 B2 * 12/2012 Kapoor ..... 296/19
8,366,167 B2 * 2/2013 Sartin et al. ..... 296/24.38
2010/0187848 A1 * 7/2010 Kapoor ..... 296/19

* cited by examiner

*Primary Examiner* — Glenn Dayoan
*Assistant Examiner* — Gregory Blankenship
(74) *Attorney, Agent, or Firm* — Calfee, Halter & Griswold LLP

(57) ABSTRACT

A removable litter support assembly for installation on a interior wall of a transport vehicle. The removable litter support assembly includes a plurality of wall supports and a plurality of straps. Each of the plurality of wall supports are generally oriented vertical and parallel to each other and in a linear orientation and each of the plurality of straps are generally oriented vertical and parallel to each other and in a linear orientation. The linear orientation of the plurality of wall supports being parallel to the linear orientation of the plurality of straps.

15 Claims, 5 Drawing Sheets

REMOVABLE LITTER SUPPORT ASSEMBLY

BACKGROUND

The transportation of supplies, patients and trained personnel is an important aspect of the medical field. In recent years, the need for transportation of patients between two locations has increased, especially in specific disciplines. For example, the federal government is a large user of medical transportation in military and veteran affairs. Exemplary transportation methods include by airplane, helicopter, truck and ambulance.

A transport vehicle has many military and veteran applications. For example, wounded military servicemen and servicewomen are often transported from an initial treatment location to a secondary area offering greater service, and generally evacuated from one location to another location. These exemplary uses and other uses of a medical transport vehicle in the military requires efficient loading, storing and unloading of patients. Patients may be loaded by litter, wheelchairs, upright seats, or by manual-assist walking.

The transportation of patients by litter in a transport vehicle has been limited by the interior configuration of the cargo area of the transport area. The use of an ambulance or small vehicle typically limits the evacuation of only one patient. The evacuation of multiple patients in a safe manner typically requires a larger bus. Regardless, any vehicle configured for multiple patients typically has a fixed interior configuration, which limits the flexibility of the transport vehicle for alternative uses.

SUMMARY

The present application describes a removable litter support assembly for the temporary storage of litters along one interior wall of a transport vehicle.

In an exemplary embodiment, the removable litter support assembly includes a includes a plurality of wall supports and a plurality of straps. Each of the plurality of wall supports are generally oriented vertical and parallel to each other and in a linear orientation and each of the plurality of straps are generally oriented vertical and parallel to each other and in a linear orientation. The linear orientation of the plurality of wall supports being parallel to the linear orientation of the plurality of straps.

BRIEF DESCRIPTION OF THE DRAWINGS

Features and advantages of the general inventive concepts will become apparent from the following detailed description made with reference to the accompanying drawings.

DETAILED DESCRIPTION

Figure 1:
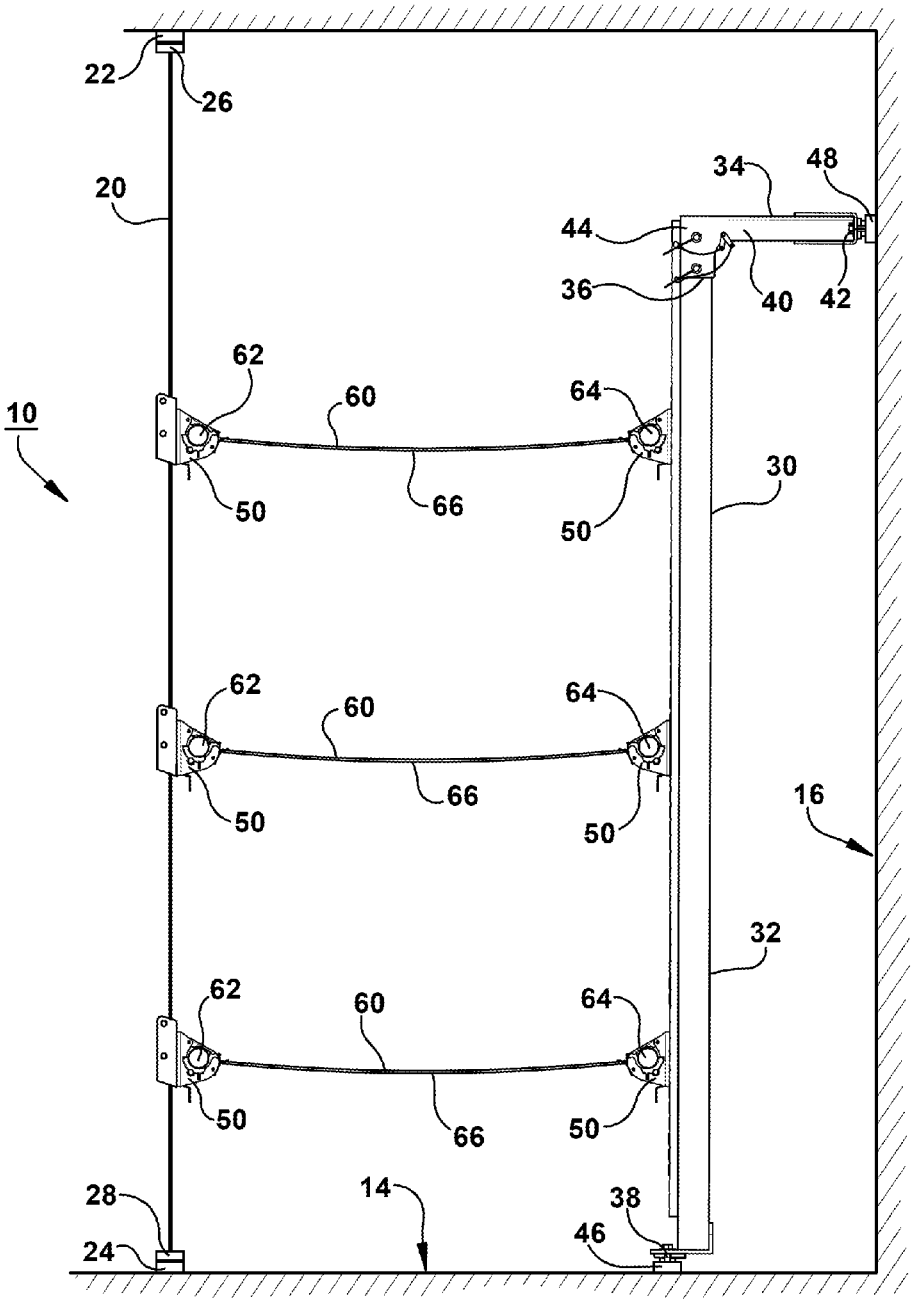
FIG. 1 is a schematic of a removable litter assembly installed in a cargo area of a transport vehicle.

This Detailed Description merely describes exemplary embodiments in accordance with the general inventive concepts and is not intended to limit the scope of the invention or the claims in any way. Indeed, the invention as described by the claims is broader than and unlimited by the exemplary embodiments set forth herein, and the terms used in the claims have their full ordinary meaning.

The general inventive concepts will now be described with occasional reference to the exemplary embodiments of the invention. This general inventive concept may, however, be embodied in different forms and should not be construed as limited to the embodiments set forth herein. Rather, these embodiments are provided so that this disclosure will be thorough and complete, and will fully convey the scope of the general inventive concepts to those skilled in the art.

Unless otherwise defined, all technical and scientific terms used herein have the same meaning as commonly understood by one of ordinary skill in the art encompassing the general inventive concepts. The terminology set forth in this detailed description is for describing particular embodiments only and is not intended to be limiting of the general inventive concepts. As used in this detailed description and the appended claims, the singular forms "a," "an," and "the" are intended to include the plural forms as well, unless the context clearly indicates otherwise.

Unless otherwise indicated, all numbers expressing quantities of ingredients, properties such as molecular pressure source, reaction conditions, and so forth as used in the specification and claims are to be understood as being modified in all instances by the term "about." Accordingly, unless otherwise indicated, the numerical properties set forth in the specification and claims are approximations that may vary depending on the suitable properties sought to be obtained in embodiments of the present invention. Notwithstanding that the numerical ranges and parameters setting forth the broad scope of the general inventive concepts are approximations, the numerical values set forth in the specific examples are reported as precisely as possible. Any numerical values, however, inherently contain certain errors necessarily resulting from error found in their respective measurements.

The term litter as used in this specification refers to any hand-carried transport vehicle for one or more humans. Exemplary litters may take the form of open chairs or beds carried by two or more men, some being enclosed for protection from the elements. An exemplary medical litter may be two poles between which fabric bedding is stretched. Four men may carry a patient on such a litter by each man holding a single end of one of the two poles.

The present invention relates to a removable litter support assembly for installation on a interior wall of a transport vehicle. The removable litter support assembly is easily and quickly changeable from an installed position on the interior wall to a stored position remote from the interior wall. In a stored position, the interior space within the cargo area in which litters may be positioned may be used for alternative uses, such as for example, by one or more wheelchairs.

In an exemplary embodiment, the removable litter support assembly is arranged for installation on an interior wall of a transport vehicle. The removable litter support assembly includes a plurality of wall supports and a plurality of straps. The plurality of wall supports each includes an elongated bar and a base portion. The elongated bar has a top end, a bottom end and a plurality of pole-receivable connectors slidably mounted between the two ends. The bottom end has a floor-mountable connector. The base portion has a wall-mountable end and a bar-mountable end. The top end of the bar is removably connected to the bar-mountable end of the base portion. The plurality of straps has a floor-mountable end, a ceiling-mountable end, and a plurality of pole-receivable connectors slidably mounted between the two ends. Each of the plurality of wall supports are generally oriented vertical and parallel to each other and in a linear orientation and each of the plurality of straps are generally oriented vertical and parallel to each other and in a linear orientation. The linear orientation of the plurality of wall supports are parallel to the linear orientation of the plurality of straps.

In another exemplary embodiment, a transport vehicle for carrying one or more medical patients is disclosed. The transport vehicle includes a cargo area, a plurality of wall supports, a plurality of straps, and at least one litter. The cargo area has an interior space defined at least in part by a ceiling, a floor and an interior wall. The cargo area is sized to contain at least one medical patient carried on a litter. Each of the plurality of wall supports has an elongated bar and a base portion. The elongated bar has a top end, a bottom end removably attached to the floor, and a plurality of pole-receivable connectors slidably mounted between the two ends. The base portion has a first end attached to the wall and a second end removably attached to the top end of the elongated bar. The plurality of straps have a top end removably attached to the ceiling, a bottom end removably attached to the floor, and a plurality of pole-receivable connectors slidably mounted between the two ends. The at least one litter has two parallel poles and a body-supporting canvas stretched therebetween. Each of the plurality of wall supports are attached to a single one of the two parallel frame members and each of the plurality of straps are attached to the other of the two parallel frame members.

In another exemplary embodiment, a method of loading at least one litter into a cargo area of a transport vehicle is disclosed. The method includes providing a transport vehicle having a cargo area defined at least in part by a ceiling, a floor, and an interior wall. The cargo area has a line of a plurality of wall supports, with a top end attached to the interior wall and a bottom end attached to the floor, and a line of a plurality of straps, with a top end attached to the ceiling and a bottom end attached to the floor. The method includes providing a litter having two parallel poles and a body-supporting canvas stretched therebetween, loading a patient onto the litter, carrying the litter onto the transport vehicle and into the cargo area through a rear entrance, attaching the litter to each of the plurality of wall mounts, and attaching the litter to each of the plurality of straps.

Referring now to the drawings, FIG. 1 is a schematic of a removable litter assembly installed in a cargo area of a transport vehicle. The exemplary assembly 10 in illustrated in an installed position within a cargo area. The cargo area is at least partially defined by a ceiling 12, a floor 14, and an interior wall 16. A strap 20 is connected to the ceiling at a top end 26 by a user detactable connection 22 and to the floor at a bottom end 28 by a user detactable connection 24. The strap can be manually removed and stored at a remote location, such as for example, within a storage area underneath the cargo area, when the assembly 10 is not in use. When broken down, this part of the cargo area can be used for other purposes, such as for example, to store a wheelchair. The strap may be constructed from any suitable material, such as for example, nylon. The connectors 28, 28 may be any suitable and conventional hardware.

A wall mount 30 is shown closer to the interior wall 30 relative the strap 20. The wall mount includes an elongated bar 32, having a top end 36 and a bottom end 38, and a base portion 32, having a bar mounting end 40 and a wall mounting end 42. When the assembly 10 is broken down, the bar 32 can be removed by a user and the base portion 32 can remain connected to the interior wall 16. As shown, the elongated bar 32 is attached at a top end 36 to by a connector 44 to a bar mounting end 40 of the base portion 34. The bottom end 38 of the bar 32 is attached by a connector 46 to the floor 14. Both connectors 44, 46 allow user detachment of the bar 32. The connector 48 attaches the base portion 34 to the interior wall 16.

The strap 20 and the wall mount 30 each include a plurality of pole-receivable connectors 50. Each connector 50 is slidable, upward or downward, within a L-track on the inwardly facing side of the elongated bar or the strap. As shown, the connectors 50 can be slid by a user so that a distinct pattern of connectors of the strap 20, in regard to distance from the floor 14 and distance from each other so as to match the distinct pattern of connectors of the wall mount 30, in regard to distance from the floor 14 and distance from each. In such a position, as generally illustrated in FIG. 1, the connectors 50 can secure a litter 60. The connectors may be an suitable and conventional quick-release mechanism. The three litters shown in FIG. 1 are constructed of two poles 62, 64 and a canvas 66 stretched therebetween. As discussed, the canvas can be constructed of any suitable material, such as for example, nylon, rubber or cloth.

When the assembly 10 includes one or more litters, two or more straps 20 and two or more wall mounts 30 are generally included in the assembly 10. In an exemplary embodiment, each of the plurality of wall supports are generally oriented vertical and parallel to each other and in a linear orientation. Likewise, each of the plurality of straps are generally oriented vertical and parallel to each other and in a linear orientation. So as to mirror the shape of the litter, the linear orientation of the plurality of wall supports are generally parallel to the linear orientation of the plurality of straps. In other words, the line formed by the plurality of straps 20 is generally the width of a litter apart from the line formed by the plurality of wall mounts 30.

When two or more litters 60 are engaged with in the assembly 10, the configuration of the assembly promotes an efficient use of the cargo space. For example, three litters may be attached within the assembly in a stacked and remote relationship. As such, each of the three litters has one of the two parallel frame members attached to each of the plurality of wall supports and the other of the two parallel frame members attached to each of the plurality of straps.

Figure 2:
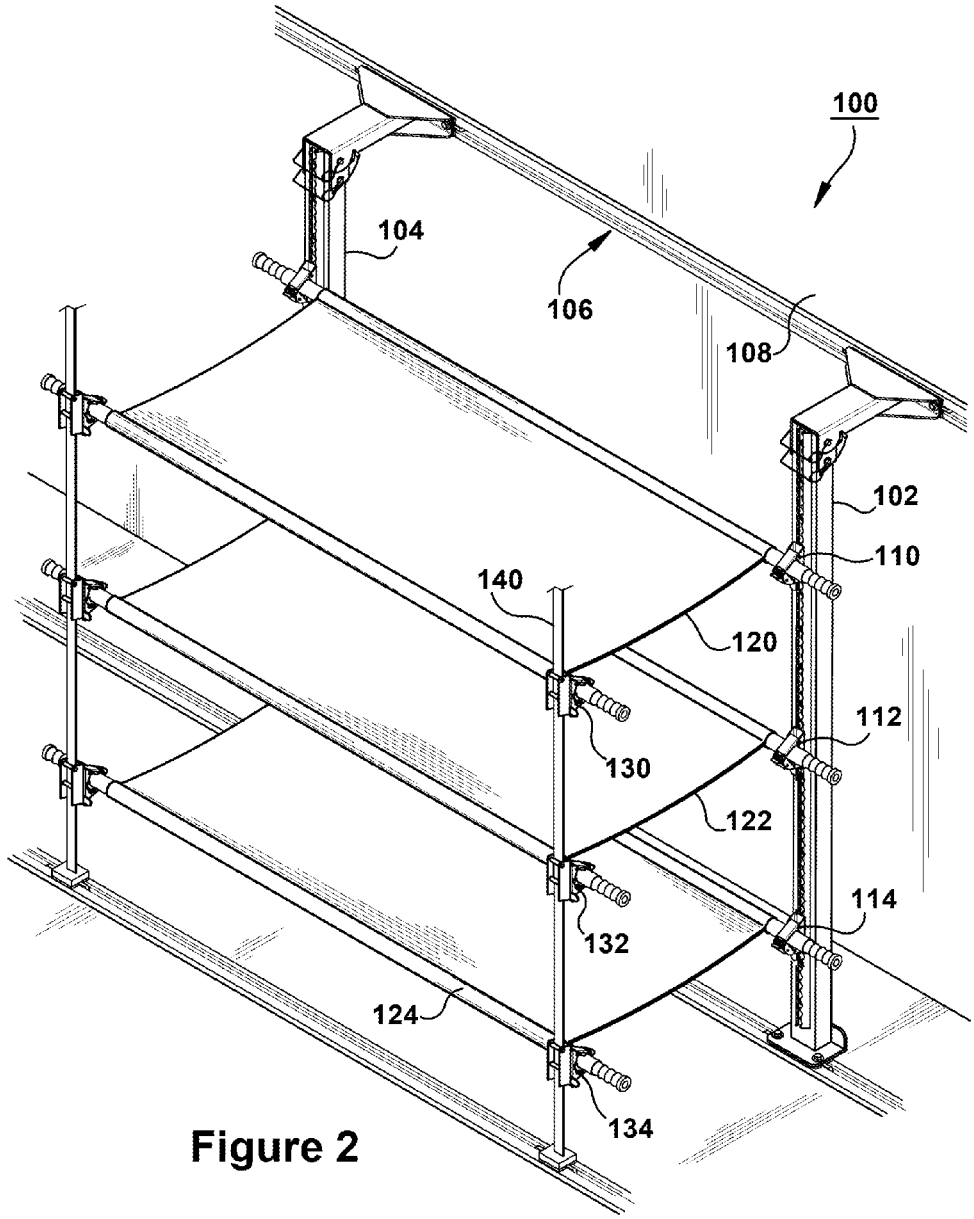
FIG. 2 is a perspective rear view of a removable litter assembly installed in a cargo area of a transport vehicle.

Referring now to FIG. 2, a perspective rear view of a removable litter assembly 100 is shown in an installed position within a cargo area of a transport vehicle. The assembly 100 includes certain similar components as the assembly 10 illustrated in FIG. 1. Two wall supports 102, 104 are attached to an interior wall 106. As shown, the wall supports 102, 104 are each attached to a track 108 and can be adjusted to the front or rear of the cargo area to accommodate a variety of uses for the transport vehicle. In regard to the wall mount support 102, three connectors 110, 112, 114 individually engage one of three poles on one of three litters 120, 122, 124. The opposite pole for each litter is engaged by connectors 130, 132, 134 on a strap 140.

Figure 3:
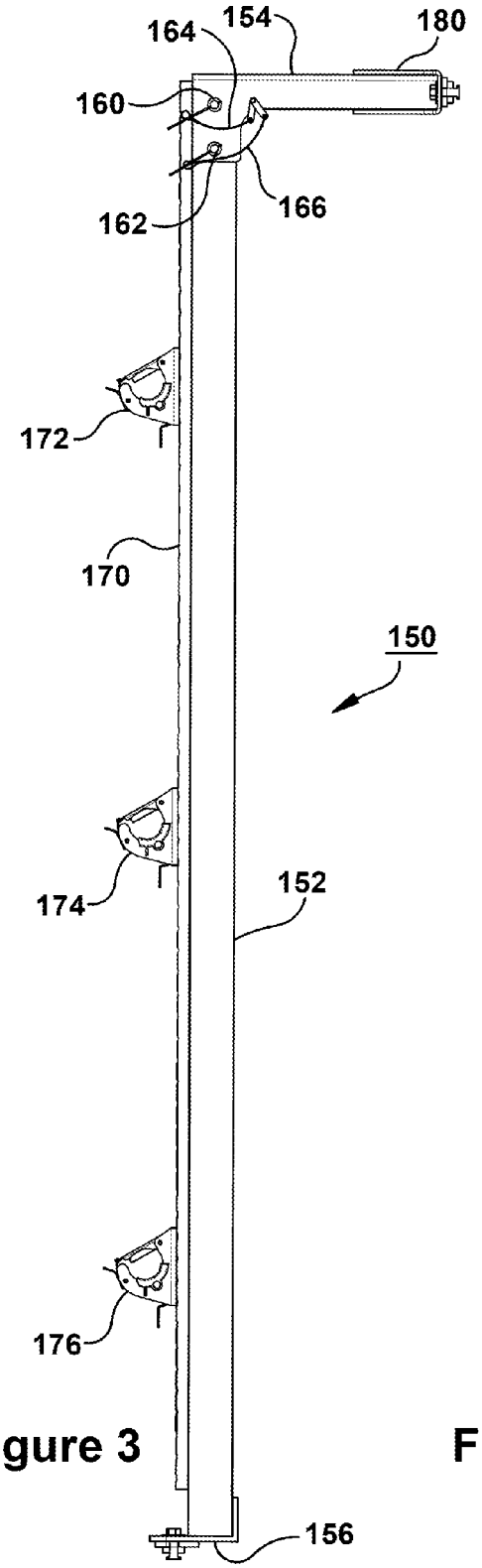
FIG. 3 is a side view of a wall support of the removable litter assembly of FIG. 2.
Figure 4:
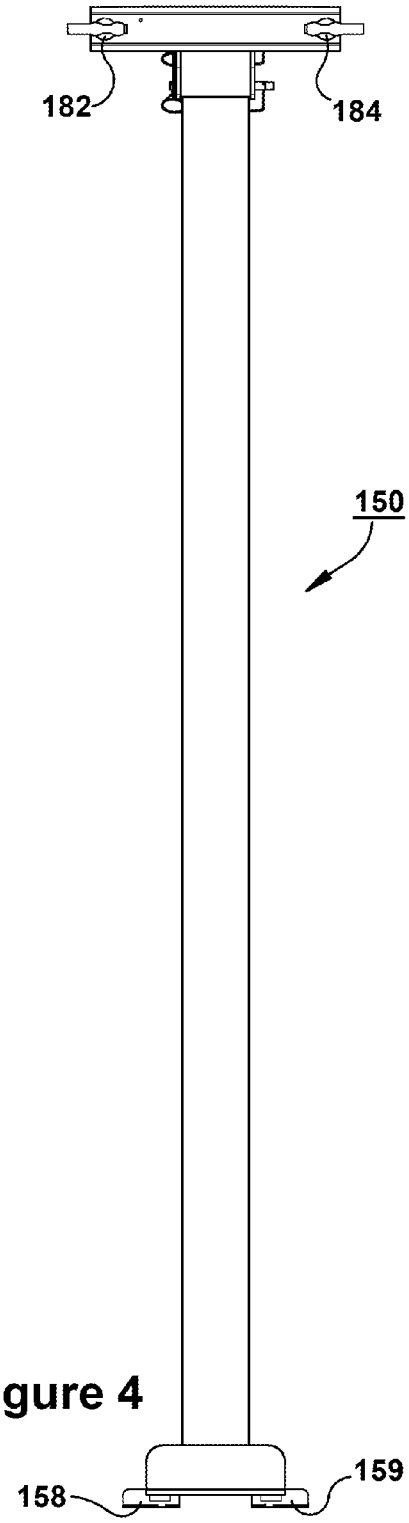
FIG. 4 is a front view of a wall support of FIG. 3.
Figure 5:
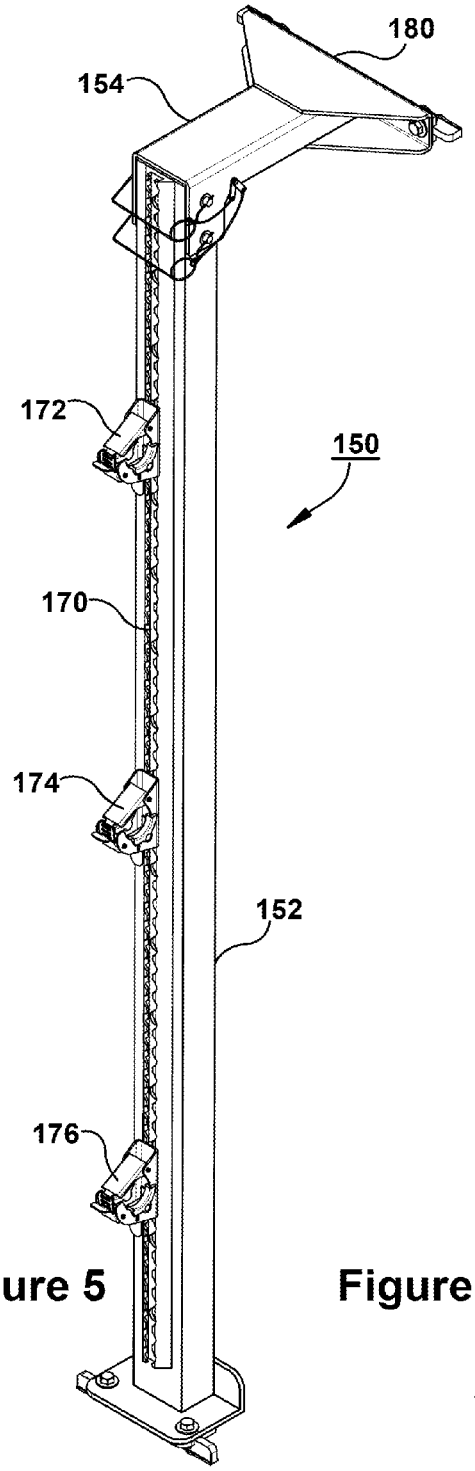
FIG. 5 is a rear perspective view of a wall support of FIG. 3.
Figure 6:
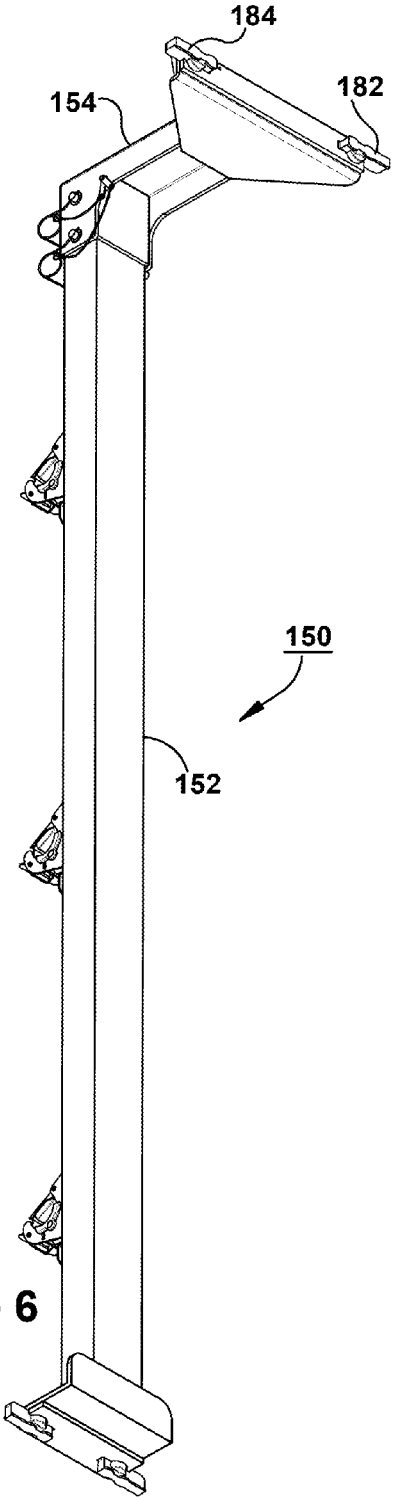
FIG. 6 is a front perspective view of a wall support of FIG. 3.

The wall support is arranged for easy assembly and disassembly by a user. FIGS. 3-7 illustrate an exemplary wall mount 150. In FIG. 3, a side view of the wall support 150 is shown. The wall support 150 includes an elongated bar 152 and a base portion 154. Alternative views are shown in a front view in FIG. 4, a rear perspective view in FIG. 5, and a front perspective view in FIG. 6.

The elongated bar 152 is positioned to face toward an interior wall when in an installed position. When installed, the elongated bar is attached to the floor by a bottom connector 156. The bottom connector includes quick engaging and disengaging hardware 158, 159. The top of the elongate bar 152 is attached to the base portion 154 by a connector. In the embodiment shown, a set of pins 160, 162 are inserted to secure the elongated bar. After the pins are pulled and the elongated bar is manually removed, two lanyards 164, 166 retain the pins to the base portion. As discussed herein, an L-track 170 is engaged to the elongated bar and faces toward the center of the cargo area. Within the L-track, pole-engaging connectors 170, 172, 174 are shown at user adjustable positions.

The base portion 154 is attached to an interior wall by a connector 180. The connector 180 includes quick engaging and disengaging hardware 182, 184. However, the elongated bar 152 is removable from the base portion 154 with the base portion remaining attached to an interior wall.

Figure 7:
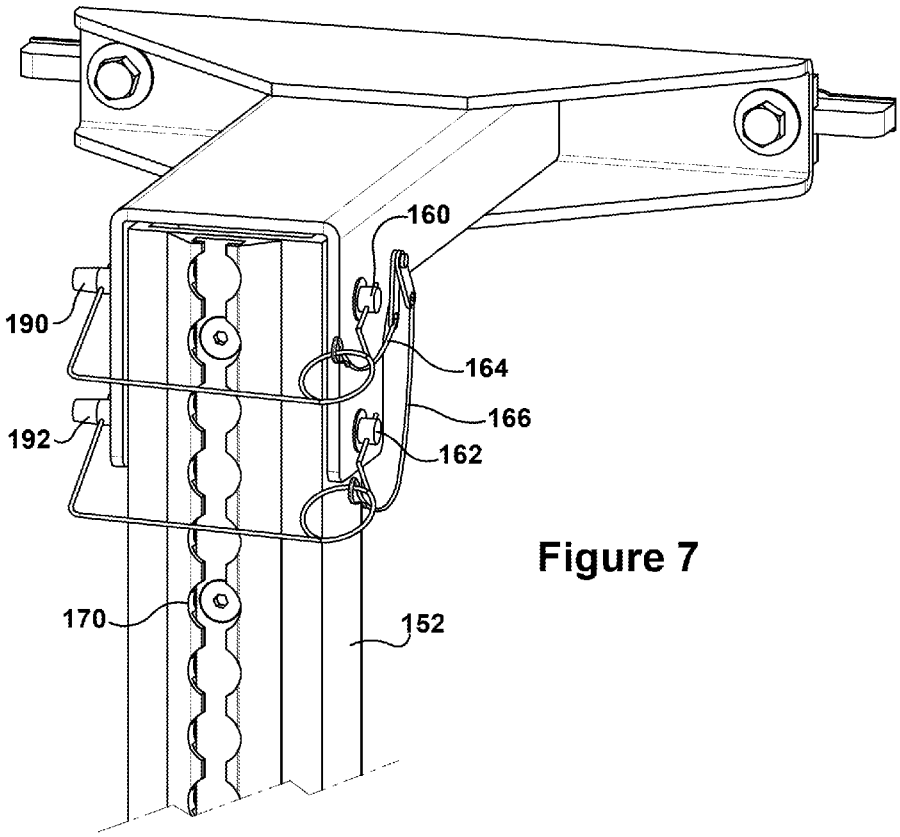
FIG. 7 is an enlarged rear perspective view of a portion of the wall support of FIG. 3.

FIG. 7 illustrates an enlarged rear perspective view of a portion of the wall support 152 of FIG. 3. As shown, the top end of the bar is attached to the bar-mountable end of the base portion by a plurality of pins 160, 162. The distal end 190, 192 of each pin 190, 192, respectively, is show protruding through an opposite side of the elongated bar 152.

The invention includes a method of loading at least one litter into a cargo area of a transport vehicle. With use of an exemplary embodiment of a transport vehicle, a litter having two parallel poles and a body-supporting canvas stretched therebetween is provided. Any litter having suitable poles may be used. It should be apparent tone with ordinary skill in the art, that a variety of litters, having a variety of poles may be used in the practice of this invention. Any pole having a shape and size with is correspondingly shaped to engage with a connector of the straps and the wall mounts of the transport vehicle may be used. After loading a loading a patient onto a suitable litter, the litter is carried onto the transport vehicle. The path taken is typically into the cargo area through a rear entrance. The litter is attached to each of the plurality of wall mounts, and then attached to each of the plurality of straps.

A second patient may be loaded onto the transport vehicle by a similar method. After providing a suitable second litter, a patient may be loaded on the second litter. The second litter is loaded onto the transport vehicle and into the cargo area through the same entrance. The second litter is attached to each of the plurality of wall mounts, with the first litter and the second litter in a stacked orientation. To complete installation, the second litter is attached to each of the plurality of straps. Three or more litters can be attached in total, depending on the height of the cargo area.

Litters can be removed from the cargo area by essentially reversing the loading method. For a litter to be removed from the transport, the litter must be removed from each of the plurality of straps, removed from each of the plurality of wall mounts, and carried off the transport vehicle through the rear entrance. In installing and removing a litter, the straps or the wall mounts can be addressed in any order.

The assembly can be broken down to temporarily create additional storage room within the cargo space. The plurality of straps may be detached from the ceiling and from the floor, and then stored at a remote location from the cargo area.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof. Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, circuits, devices and components, software, hardware, control logic, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A removable litter support assembly for installation on an interior wall of a transport vehicle, the assembly comprising:

a plurality of wall supports, each of the plurality of wall supports comprising:

an elongated bar having a top end, a bottom end and a plurality of pole-receivable connectors slidably mounted between the two ends, the bottom end having a floor-mountable connector; and a base portion having a wall-mountable end and a bar-mountable end;

wherein the top end of the bar is removably connected to the bar-mountable end of the base portion; and a plurality of straps having a floor-mountable end, a ceiling-mountable end, and a plurality of pole-receivable connectors slidably mounted between the two ends;

wherein each of the plurality of wall supports are generally oriented vertical and parallel to each other and in a linear orientation and each of the plurality of straps are generally oriented vertical and parallel to each other and in a linear orientation, the linear orientation of the plurality of wall supports being parallel to the linear orientation of the plurality of straps.

2. The removable litter support assembly of claim 1, wherein each of the plurality of wall supports are spaced at least a width of a litter apart from each of the plurality of straps.

3. The removable litter support assembly of claim 1, wherein the elongated bar of each of the plurality of wall supports defines an L-track.

4. The removable litter support assembly of claim 3, wherein each of the plurality of pole-receivable connectors is adjustable upwardly and adjustable downwardly within the L-track.

5. The removable litter support assembly of claim 1, wherein each of the plurality of straps is user detactable at the floor-mountable end and user detactable at the ceiling-mountable end.

6. The removable litter support assembly of claim 1, wherein the top end of the bar is user detactable at the bar-mountable end of the base portion.

7. The removable litter support assembly of claim 1, wherein the top end of the bar is attached to the bar-mountable end of the base portion by a plurality of pins.

8. The removable litter support assembly of claim 1, wherein each of the plurality of pole-receivable connectors comprises a quick-release mechanism.

9. The removable litter support assembly of claim 1, wherein the plurality of pole-receivable connectors of an elongated bar are positionable in a distinct pattern relative the bottom end of the elongated bar and in the same pattern as the plurality of pole-receivable connectors of a correspondingly positioned one of a plurality of straps.

10. A transport vehicle for carrying one or more medical patients, the transport vehicle comprising:

a cargo area having an interior space defined at least in part by a ceiling, a floor and an interior wall, the cargo area being sized to contain at least one medical patient carried on a litter;

a plurality of wall supports, each of the plurality of wall supports having:

an elongated bar having a top end, a bottom end removably attached to the floor, and a plurality of pole-receivable connectors slidably mounted between the two ends; and a base portion having a first end attached to the wall and a second end removably attached to the top end of the elongated bar;

a plurality of straps having a top end removably attached to the ceiling, a bottom end removably attached to the floor, and a plurality of pole-receivable connectors slidably mounted between the two ends;

at least one litter having two parallel poles and a body-supporting canvas stretched therebetween;

wherein each of the plurality of wall supports are attached to a single one of the two parallel poles and each of the plurality of straps are attached to the other of the two parallel poles.

11. The transport vehicle of claim 10 further comprising at least three litters, wherein each of the three litters has one of the two parallel poles attached to each of the plurality of wall supports and the other of the two parallel poles attached to each of the plurality of straps.

12. The transport vehicle of claim 10, wherein the elongated bar of each of the plurality of wall supports includes an L-track.

13. The transport vehicle of claim 12, wherein each of the plurality of pole-receivable connectors of the elongated bar is adjustable upwardly and downwardly within the L-track.

14. The transport vehicle of claim 13, wherein each of the plurality of straps is manually detactable at the floor and at the ceiling.

15. The transport vehicle of claim 10, wherein the elongated bar is detachable from the base portion with the base portion remaining fixed to the interior wall.

* * * * *